United States Patent [19]

Yamamura

[11] Patent Number: 5,059,955

[45] Date of Patent: Oct. 22, 1991

[54] APPARATUS FOR PRODUCING VIDEO SIGNALS

[75] Inventor: Kimio Yamamura, Tokyo, Japan

[73] Assignee: Hudson Soft Co. Ltd., Hokkaido, Japan

[21] Appl. No.: 239,201

[22] Filed: Aug. 30, 1988

[30] Foreign Application Priority Data

Sep. 2, 1987 [JP] Japan ..... 62-219989
Sep. 2, 1987 [JP] Japan ..... 62-219990

[51] Int. Cl.[5] ..... G09G 1/28

[52] U.S. Cl. ..... 340/701; 340/703; 358/11

[58] Field of Search ..... 340/703, 702, 701, 814, 340/749; 358/17, 18, 19, 11, 23

[56] References Cited

U.S. PATENT DOCUMENTS

| | | | |
|---|---|---|---|
| 4,104,624 | 8/1979 | Hamada | 340/750 |
| 4,258,385 | 3/1981 | Greenberg | 340/703 |
| 4,360,804 | 11/1982 | Ohura | 340/703 |
| 4,442,428 | 4/1984 | Dean et al. | 340/749 |
| 4,484,187 | 11/1984 | Brown et al. | 340/723 |
| 4,485,378 | 11/1984 | Matsui et al. | 340/750 |
| 4,727,361 | 2/1988 | Tokumitsu | 340/703 |

OTHER PUBLICATIONS

Artwick, "Microcomputers Displays, Graphics, and Animation", Prentice-Hall, Inc. New Jersey, 1985, p. 308.

*Primary Examiner*—Jeffery A. Brier
*Attorney, Agent, or Firm*—Lowe, Price, LeBlanc and Becker

[57] ABSTRACT

In an apparatus for producing video signals in which a memory storing color data is addressed with an address signal determined by video data to produce color data, an analog RGB signal producing circuit in which the color data read from the memory are converted to analog signals is provided so that a color image can be displayed on a CRT or an exclusively used monitor means to which the color data are directly supplied. Further, a signal conversion circuit, a video color signal producing circuit and a composite circuit are provided wherein a luminance signal and color difference signals are produced in accordance with the color data in the signal conversion circuit, and the luminance signal is converted to an analog luminance signal and color carriers are produced by modulating analog signals converted from the color difference signals with the color subcarriers in the video color signal producing circuit. In the composite circuit, the analog luminance signal, the color carriers and a burst signal obtained in accordance with the color subcarriers are combined to produce a composite signal so that a color image can be displayed on a CRT to which the composite signal is supplied through a receiving circuit of a television set.

3 Claims, 7 Drawing Sheets

FIG. 3

| CS | A1 | A2 | R/W | SYMBOL | REGISTER | A0 | | | | | | | | | | | | | | | |
|---|---|---|---|---|---|---|---|---|---|---|---|---|---|---|---|---|---|---|---|---|---|
| | | | | | | 1 | | | | | | | | | | 0 | | | | | |
| | | | | | | 15 | 14 | 13 | 12 | 11 | 10 | 9 | 8 | 7 | 6 | 5 | 4 | 3 | 2 | 1 | 0 |
| 1 | | | | | | | | | | | | | | | | | | | | | |
| 0 | 0 | 0 | W | CR | CONTROL REGISTER | | | | | | | | | DCC | | | | | | | |
| 0 | 1 | 0 | W | CTA | COLOR TABLE ADDRESS REGISTER | | | | | | | | | | CTA | | | | | | |
| 0 | 0 | 1 | W | CTW | COLOR TABLE DATA WRITE REGISTER | | | | | | | | | | | G | R | B | | | |
| 0 | 0 | 1 | R | CTR | COLOR TABLE DATA READ REGISTER | | | | | | | | | | | G | R | B | | | |

FIG. 4

| DCC | DIVIDING RATIO | fCLOCK | fck |
|---|---|---|---|
| 00H | 4 | 6fsc | 1.5fsc |
| 01H | 3 | 6fsc | 2fsc |

FIG. 5
| VD8 | VD7 | VD6 | VD5 | VD4 | VD3 | VD2 | VD1 | VD0 |
|---|---|---|---|---|---|---|---|---|
| 0 | AREA COLOR (BLOCK DESIGNATION) | | | | PATTERN COLOR | | | |
| 1 | AREA COLOR (BLOCK DESIGNATION) | | | | PATTERN COLOR | | | |
FIG. 6A
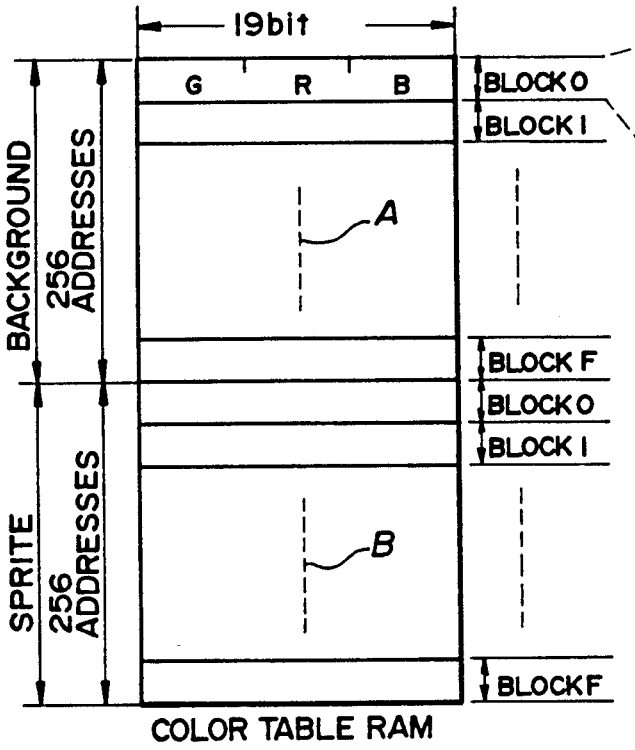
FIG. 6B
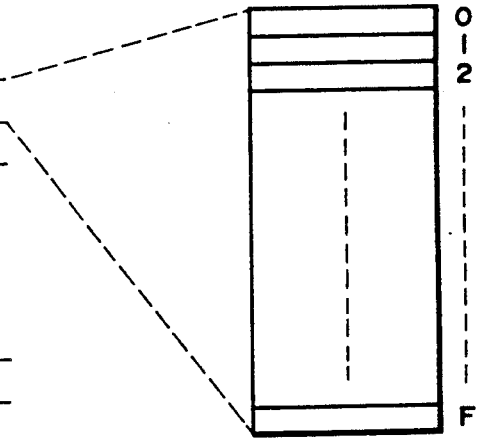

FIG. 7

| MATRIX ROM ADDRESS | | | VIDEO COLOR SIGNAL | | |
|---|---|---|---|---|---|
| G | R | B | B-Y (HEX) | R-Y (HEX) | Y (HEX) |
| 000 | 000 | 000 | 10 | 0F | 00 |
| 000 | 000 | 001 | 12 | 0F | 00 |
| 000 | 000 | 010 | 14 | 0F | 01 |
| 000 | 000 | 011 | 16 | 0F | 01 |
| 000 | 000 | 100 | 18 | 0F | 02 |
| 000 | 000 | 101 | 1A | 0F | 02 |
| 000 | 000 | 110 | 1C | 0F | 03 |
| 000 | 000 | 111 | 1E | 0F | 03 |
| 000 | 001 | 000 | 0E | 12 | 01 |
| 000 | 001 | 001 | 11 | 12 | 02 |
| 000 | 001 | 010 | 13 | 12 | 02 |
| | | | | | |
| 111 | 111 | 010 | 05 | 0F | 1D |
| 111 | 111 | 011 | 07 | 0F | 1D |
| 111 | 111 | 100 | 09 | 0F | 1E |
| 111 | 111 | 101 | 0B | 0F | 1E |
| 111 | 111 | 110 | 0D | 0F | 1F |
| 111 | 111 | 111 | 10 | 0F | 1F |

D0~D8
VD0~VD8
FIRST F/F
25a
ADDRESS SELECTOR
25
COLOR TABLE RAM
26
SECOND F/F
27a
THIRD F/F
27b
42
MATRIX ROM
31
FOURTH F/F
R
G
B
CK
CS
DELAY CIRCUIT
43

APPARATUS FOR PRODUCING VIDEO SIGNALS

FIELD OF THE INVENTION

The invention relates to an apparatus for producing video signals, and more particularly to an apparatus for producing video signals in which analog RGB signals and a composite signals are produced selectively.

BACKGROUND OF THE INVENTION

In one of conventional apparatus for producing video signals, analog signals having amplitudes of R(red), G(green) and B(blue) are produced to be supplied to an exclusively used monitor means. The apparatus for producing video signals comprises a video RAM for storing video data, a color data RAM for storing color data, and a digital to analog converter for converting digital color data to analog color data.

In the apparatus for producing video signals, video data for each picture element are read from the video RAM, and the color data RAM is then addressed in accordance with an address signal which is of video data read from the video data RAM so that color data are read therefrom. Then, the color data are converted in the digital to analog converter to analog RGB signals which are supplied to the exclusively used monitor means so that a color image is displayed on the exclusively used monitor means. Color data are written into the color data RAM in accordance with a transfer thereof from a CPU thereto during horizontal and vertical retrace times so that a predetermined color image can be displayed in accordance with the color data.

According to the conventional apparatus for producing video signals, however, a color image can not be displayed on a CRT display of a television set to which a composite signal is required to be supplied because analog RGB signals are only produced therein. Although a composite signal is produced in accordance with a calculation based on analog RGB signals, a circuit construction becomes complicated so that an integrating density can not be increased as expected. Further, a hue of the color image is different from that in a television set even if such a composite signal is obtained in the calculation. Still further, flicker is occurred on a display at boarder color region due to indeterminate data of the CPU and the color data RAM in a case where color data are read from the color data RAM during the aforementioned transfer from the CPU to the color data RAM.

SUMMARY OF THE INVENTION

Accordingly, it is an object of the invention to provide an apparatus for producing video signals in which analog RGB signals and a composite signal are produced selectively.

It is a further object of the invention to provide an apparatus for producing video signals in which flicker is prevented from being occurred on a display during a transfer of color data.

According to the invention, an apparatus for producing video signal comprises, means for storing RGB color data at addresses defined in accordance with video data, means for producing analog RGB signals in accordance with a digital to analog conversion of said RGB color data, means for producing a luminance signal and color difference signals in accordance with said RGB color data, means for converting said luminance signal to an analog luminance signal and for producing color carriers by modulating analog signals converted from said color difference signals in accordance with color subcarriers, and means for producing a composite signal by combining said analog luminance signal, said color carriers and a burst signal obtained in accordance with one of said color subcarriers.

BRIEF DESCRIPTION OF THE DRAWINGS

The invention will be explained in more detail in conjunction with appended drawings wherein.

FIG. 3 is an explanatory diagram explaining registers used in an apparatus for producing video signals in the embodiment, FIG. 4 is an explanatory diagram explaining a dividing ratio of an oscillation frequency, FIG. 5 is an explanatory diagram explaining video data, FIGS. 6A and 6B are explanatory diagrams showing a color table RAM in an apparatus for producing video signals in the embodiment, FIG. 7 is an explanatory diagram showing a matrix ROM in an apparatus for producing video signal in the embodiment.

DESCRIPTION OF THE PREFERRED EMBODIMENTS

Figure 1:
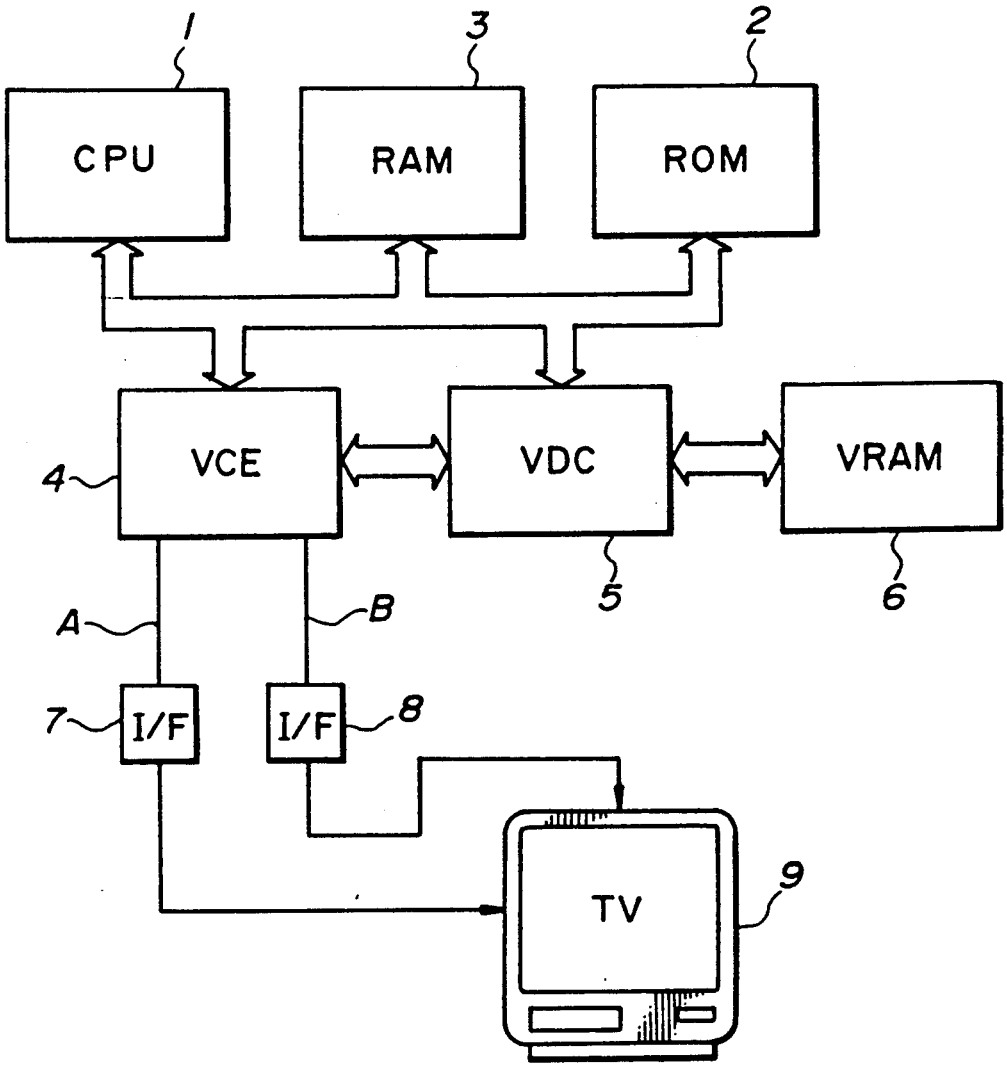
FIG. 1 is a block diagram showing a color image displaying apparatus to which an apparatus for producing video signals in an embodiment according to the invention is applied.

In FIG. 1, there is shown a color image displaying apparatus to which an apparatus for producing video signals is applied. The color image displaying apparatus comprises a CPU 1 for controlling the whole system, a ROM 2 for storing programs by which the whole system is controlled, a RAM 3 for storing data and calculation results temporarily, a video color encoder 4 which is an apparatus for producing video signals in the invention and which produces output signals A of analog RGB signals and B of a composite signal, a video display controller 5 for controlling a supply of video data to the video color encoder 4, a video RAM(VRAM) 6 for storing video data to be supplied to the video color encoder 4, and a television set 9 for displaying a color image in accordance with the analog RGB signals or the composite signal.

Figure 2:
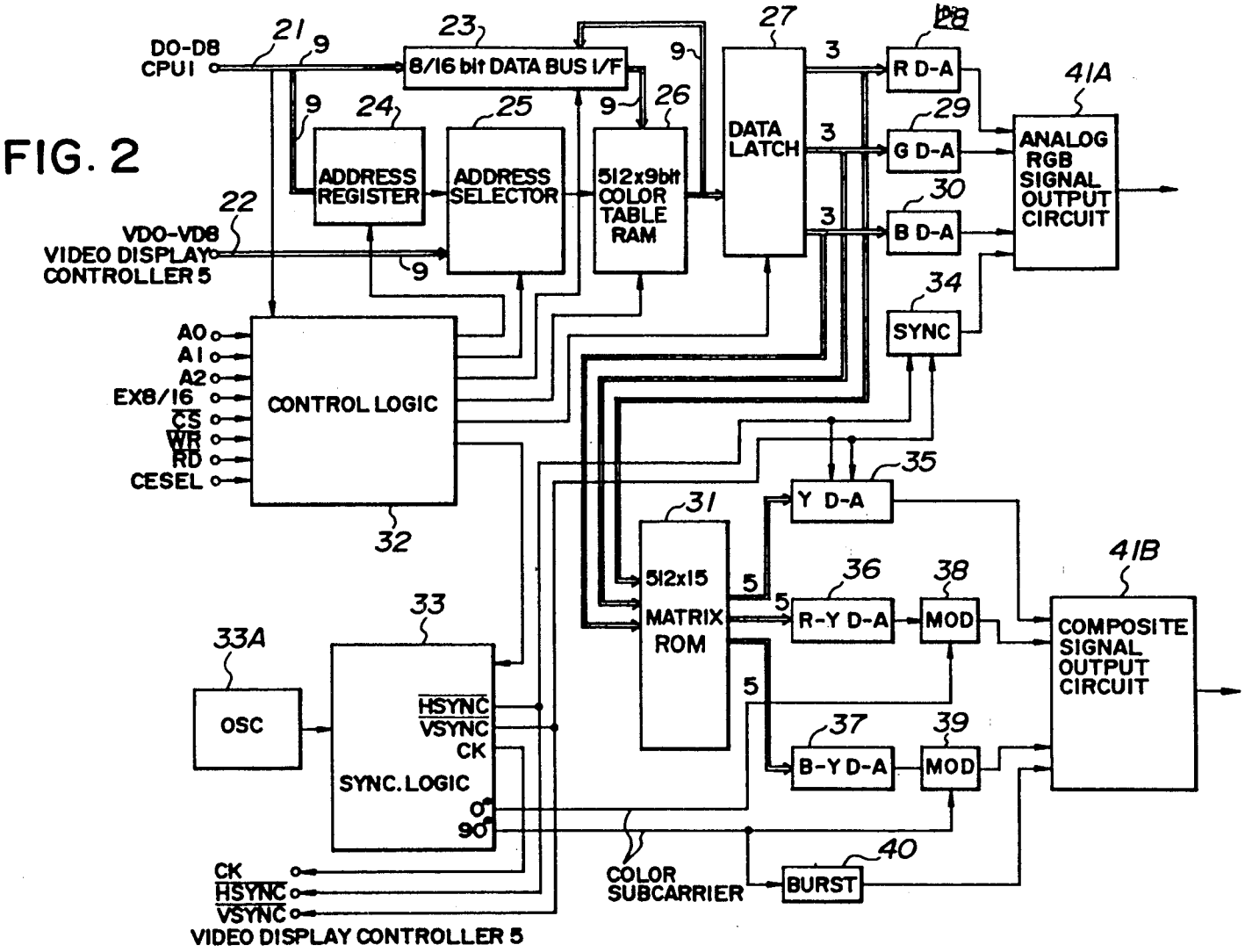
FIG. 2 is a block diagram showing an apparatus for producing video signals in the embodiment.

FIG. 2 shows the video color encoder 4 which is an apparatus for producing video signals in the embodiment according to the invention. In the video color encoder 4, a 8/16 bit data bus interface 23 and an address register 24 are provided to be connected through a data bus 21 of nine bits D0 to D8 to the CPU 1 (FIG. 1), and an address selector 25 is provided to be connected through a data bus 22 of nine bits VD0 to VD8 to the video display controller 5 (FIG. 1). The 8/16 bit data bus interface 23 has a function that the video color encoder 4 is connected to the CPU 1 of eight bits or sixteen bits, and the address selector 25 selects one data from data in the address register 24 and data on the data bus 22 as an address signal. A color table RAM 26 is connected to the 8/16 bit data bus interface 23, and a data latch circuit 27 having three outputs for R, G and B color data is connected to the color table RAM 26 so that color data read from the color table RAM 26 are latched in the data latch circuit 27. The three outputs of the data latch circuit 27 are connected to digital to analog converters 28, 29 and 30 for R, G and B color data and to a matrix ROM 31 having a signal conversion matrix therein in which color data are converted to a luminance signal Y, and color difference signals R-Y and B-Y. The 8/16 bit data bus interface 23, the address register 24, the address selector 25, the color table RAM 26, and the data latch circuit 27 are controlled together with a synchronous signal producing circuit 33 by a control circuit 32 having inputs of a 8/16 bit selection signal EX 8/$\overline{16}$, a chip selection signal $\overline{CS}$, a writing signal $\overline{WR}$, a reading signal $\overline{RD}$, an output control signal CESEL etc. The synchronous signal producing circuit 33 receives an oscillation signal of a sinusoidal wave having a frequency of, for instance, 21.47727 MHz from an oscillation circuit 33A and produces horizontal and vertical synchronous signals $\overline{HSYNC}$ and $\overline{VSYNC}$, dot clock signals CK, color subcarriers etc. The R, G and B digital to analog converters 28, 29 and 30 are connected to an analog RGB signal output circuit 41A to which a synchronous signal composite circuit 34 is also connected. Outputs of the matrix ROM 31 are connected to digital to analog converters 35, 36 and 37 for the luminance signal Y, and the color difference signals R-Y and B-Y. The R-Y and B-Y digital to analog converters 36 and 37 are connected to modulators 38 and 39 in which the two color subcarriers of the same frequency and different phases by ninety degrees supplied from the synchronous signal producing circuit 33 are modulated by the color difference signals R-Y and B-Y, respectively, so that color carrier signals are produced therein. One of the color subcarriers is also supplied to a burst circuit 40 in which a burst signal is produced by inserting the color subcarrier of eight or nine cycles at a period of back porch of the horizontal synchronous signal. In the Y digital to analog converter 35, the luminance signal is combined with the synchronous signals. The Y digital to analog converter 35, the modulators 38 and 39, and the burst circuit 40 are connected to a composite signal output circuit 41B.

In FIG. 3, there are explained a control register CR, a color table address register CTA, a color table data write register CTW, and a color table data read register CTR included in the control circuit 32. These registers are enabled with the chip selection signal $\overline{CS}$ "0" and one of them is selected with a content of the address $A_1$ and $A_2$ as follows.

| $A_1$ | $A_2$ | REGISTER | |
|---|---|---|---|
| 0 | 0 | CONTROL REGISTER | CR |
| 1 | 0 | COLOR TABLE ADDRESS REGISTER | CTA |
| 0 | 1 | COLOR TABLE DATA WRITE REGISTER | CTW |
| | | COLOR TABLE DATA READ REGISTER | CTR |

In regard to a bit width selection, a bit width of sixteen bits is selected when the signal EX 8/$\overline{16}$ is "0", while a bit width of eight bits is selected when the signal EX 8/$\overline{16}$ is "1". In a case where the eight bit width is selected, transferred data are of a lower byte for a register when the address A0 is "0", and transferred data are of an upper byte for a register when the address A0 is "1".

The control register CR includes frequency dividing data DCC in lower eight bits. In FIG. 4, there is explained a relation between an oscillation frequency of a sinusoidal wave in the oscillation circuit 31A and a square wave dot clock frequency CK wherein the dividing ratio is "four" when the content DCC is "00H", and the dividing ratio is "three" when the content DCC is "01H". In FIG. 4, the expression "$f_{sc}$" indicates a frequency of a color subcarrier so that the expression "$6f_{sc}$" means that a sinusoidal wave having a frequency of six times that of the color subcarrier is supplied to the synchronous signal producing circuit 33. Thus, the frequency dividing ratio of the synchronous signal producing circuit 33 is controlled by the control register CR.

The color table address register CTA includes a starting address CTA at lower nine bits. The starting address is an address for the color table RAM 26 from which data transferred from the CPU 1 are started to be written into the color table RAM 26. When an address is set in the address register 24, the address is automatically incremented by one each time when data are read or written.

The color table data write register CTW and the color table data read register CTR include three bit color data for R, G and B at lower nine bits respectively, and are used for a transfer of data between the CPU 1 and the color table RAM 26.

FIG. 5 shows video data VD0 to VD8 supplied from the video display controller 5. The most significant bit VD8 defines a kind of data, that is, when the bit VD8 is "0", the data VD0 to VD7 are of a background, and when the bit VD8 is "1", the data VD0 to VD7 are of a sprite. In the data VD0 to VD7, the upper four bits VD4 to VD7 are of an address signal for addressing area color (a designation of a block), and the lower four bits VD0 to VD3 are of an address signal for addressing one color data in a block.

FIGS. 6A and 6B show the color table RAM 26 in which a region A includes color data for a background, and a region B includes color data for sprites. The regions A and B includes sixteen blocks O to F each including sixteen addresses O to F. The color table RAM 26 includes a memory region for color data R, G and B each being of three bits. As apparent from the above, the regions A and B have two hundreds fifty six (256) addresses respectively so that five hundreds twelve (512) colors can be displayed.

FIG. 7 shows the matrix ROM 31 which stores luminance signals Y, color difference signals B-Y and R-Y at addresses of R, G an B color signals read from the color table TAM 26 to be latched in the latch circuit 27. For instance, when the color data are that G is "000", R is "000", and B is "010", the color difference signals B-Y and R-Y are 14(hexadecinormal) and OF(hexadecinormal), and the luminance signal is 01(hexadecinormal).

Figure 8A:
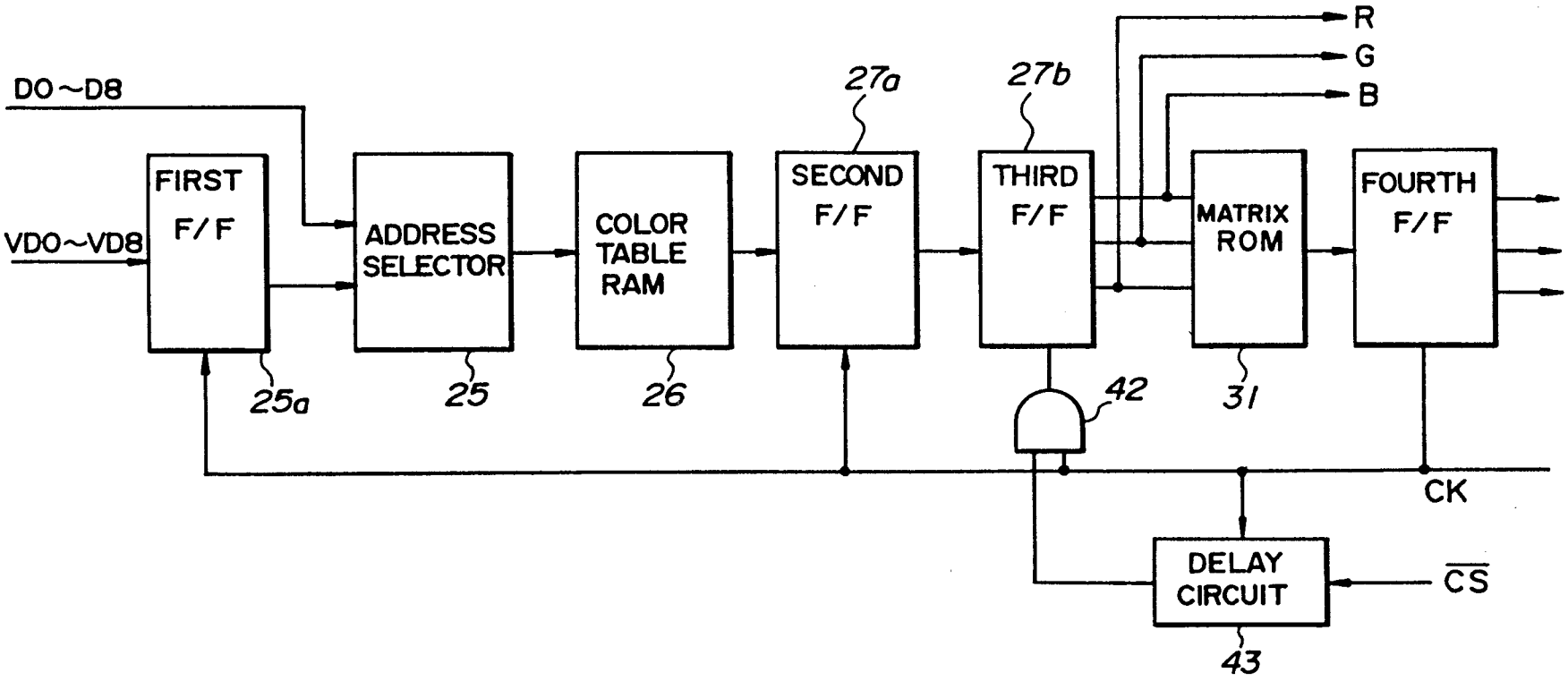
FIGS. 8A and 8B are a block diagram showing an apparatus for producing video signals in the embodiment and a timing chart in operation.

FIG. 8A shows the address selector 25, the color table RAM 26 and the matrix ROM 31 as shown in FIG. 2. A first flip-flop **25*a* is provided to function as a latch circuit at a front stage of the address selector 25, and second and third flip-flops 27*a* and 27*b* are provided as the latch circuit 27 in FIG. 2 at a rear stage of the color table RAM 26. The operation of the first to third flip-flops 25*a*, 27*a* and 27*b* are controlled with timings of dot clocks CK, provided tat the third flip-flop 27*b* is controlled with dot clocks CK passed through an AND circuit 42 having two inputs connected to a dot clock terminal and a delay circuit 43. The delay circuit 43 produces a signal "0" when the chip selection signal $\overline{CS}$ is "0", and a signal "1" when a predetermined time T is elapsed after the chip selection signal $\overline{CS}$ becomes "1" from "0". A fourth flip-flop is connected to an output of the matrix ROM 31**.

In operation, color data are first written into the color table RAM 26 through a process in which the color table address register CTA is addressed with address signals $A_1$ and $A_2$ of "1" and "0" so that a starting address CTA of the color table RAM 26 is set therein. In a case where the sixteen bit width is selected, the starting address is set by one time. While, in a case where the eight bit width is selected, the starting address is set in such a manner that a lower byte is first set therein and an upper byte is then set therein. Next, color data are written into the color table RAM 26 at the address in such a manner that the color data are written thereinto by one time in case of sixteen bit width, while a lower byte thereof and then an upper byte thereof are written thereinto in case of eight bit width. Then, an address of the color table RAM 26 is automatically incremented so that color data are successively written thereinto.

When video data as shown in FIG. 5 are transferred through the data bus 22 from the video display controller 5 to the video color encoder 4, the address selector 25 selects the transferred video data to decide an address of the color table RAM 26 as shown in FIGS. 6A and 6B so that color data of R, G and B are read therefrom to be latched in the latch circuit 27 in accordance with the dot clock CK. At this moment, one of regions A and B is selected dependent on a content of the VD8 bit as described before, and a predetermined block is selected in the selected region A or B dependent on a content of the VD4 to VD7 bits. In the selected block, a predetermined address is accessed dependent on a content of the VD0 to VD3 bits. When color data are latched in the latch circuit 27, analog RGB signals or a composite signal can be supplied from the analog RGB signal output circuit 41A or the composite signal output circuit 41B through the interface 7 or 8 to the television set 9.

(1) Output of analog RGB signals

When the frequency dividing ratio DCC of the control register CR is set to be "01H", the frequency dividing ratio is "three" as shown in FIG. 4. Digital RGB color data in the latch circuit 27 are converted in the R, G and B digital to analog converters 28, 29 and 30 to produce analog RGB signals. Simultaneously, horizontal and vertical synchronous signals $\overline{HSYNC}$ and $\overline{VSYNC}$ supplied from the synchronous circuit 33 are combined in the synchronous signal composite circuit 34 to produce a composite synchronous signal. Then, these analog RGB and composite synchronous signals are supplied from the analog RGB signal output circuit 41A directly to the CRT of the television set 9 or to an exclusively used monitor means (not shown). The analog RGB signals thus supplied thereto are of a video band of 7 MHz. On the contrary, the video band will be 5 MHz, if the frequency dividing ratio is set to "four".

(2) Output of a composite signal

When the dividing ratio DCC of the control register CR is set to be "00H", the dividing ratio is "four". A luminance signal Y and color difference signals R-Y and B-Y are supplied from the matrix ROM in accordance with R, G and B color data latched in the latch circuit 27, and then converted in the digital to analog converters 35, 36 and 37 to analog signals. At this moment, the luminance signals Y are combined with the synchronous signals from the synchronous signal producing circuit 33. On the other hand, color carriers are obtained from the balanced modulation of color subcarriers having the same frequency and different phases by ninety degrees, which are supplied from the synchronous signal producing circuit 33 in accordance with the color difference signals R-Y and B-Y. Further, a burst signal is obtained from the insertion of the color subcarrier of eight or nine cycles into a back porch period of the horizontal synchronous signal in the burst signal producing circuit 40. These signals thus obtained are combined in the composite signal output circuit 41B to produce a composite signal which is then supplied through the interface 8 to a receiving circuit of the television set 9 to be displayed on the CRT thereof. The composite signal is of a video band of 5 MHz and is based on a system of NTSC. As a matter of course, the video band may be 7 MHz as described before.

Figure 8B:
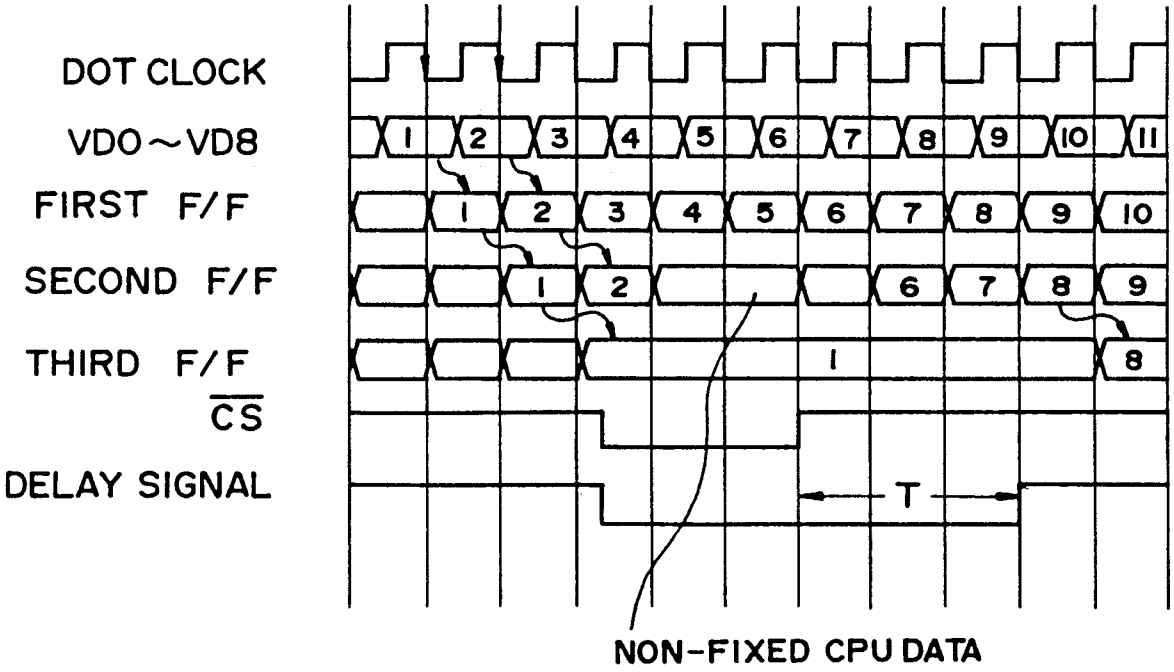

Next, a timing at which RGB color data are latched in the latch circuit 27 with the dot clock CK will be described in more detail in conjunction with FIGS. 8A and 8B.

When video data VD0 to VD8 are transferred from the video display controller 5 to the video color encoder 4, the video data are latched in the first flip-flop 25*a*, and the color table RAM 26 is addressed with an address signal of the video data VD0 to VD8 so that RGB color data are read from the color table RAM 26 to be latched in the second flip-flop 27*a*. When a first bit of the second flip-flop 27*a* is latched in the third flip-flop 27*b*, it is assumed that the chip selection signal $\overline{CS}$ becomes "0" for the purpose that data are written into the color table RAM 26 by the CPU 1. As a result, an output of the delay circuit 43 becomes "0" to result in no output of the dot clock CK from the AND circuit 42. Therefore, a second bit and signals following after the second bit in the second flip-flop 27*a* are prevented from being latched in the third flip-flop 27*b*. Thereafter, when the chip selection signal $\overline{CS}$ becomes "1", the delay circuit 43 times a predetermined time T, and when the time T is elapsed, an output of the delay circuit 43 becomes "1". Accordingly, the dot clock CK is again supplied to the third flip-flop 27*b* so that an eight bit and signals following after the eight bit in the second flip-flop 27*a* are latched in the third flip-flop 27*b* to be supplied to a following stage as digital RGB signals. At this moment, an output of RGB color data is prohibited during an indeterminate period of data in the color table RAM 26 so that flicker caused by a transfer of data between the CPU 1 and the color table RAM 26 is prevented from being occurred on the display. In the color table RAM 26, one of the regions A and B is selected dependent on a content of the VD8 bit, and one of blocks is selected dependent on a content of the VD4 to VD7 bits in the selected region A or B. In the selected block, one of addresses is accessed dependent on a content of the VD0 to VD3 bit. When color data are latched in the third flip-flop 27*b*, analog RGB signals and a composite signal can be produced as described before.

Although the invention has been described with respect to specific embodiment for complete and clear disclosure, the appended claims are not to thus limited but are to be construed as embodying all modification and alternative constructions that may occur to one skilled in the art which fairly fall within the basic teaching herein set forth.

What is claimed is:

1. An apparatus for providing video signals, comprising:

a color table RAM for storing RGB color data at addresses defined by video data, said addresses including a first group of addresses for background RGB color data and a second group of addresses for sprite RGB color data, each group of said addresses including plural blocks each including plural addresses, and said video data including a bit designating one of said first and second groups, a predetermined number of bits designating one of said plural blocks, and a predetermined number of bits designating an address in a designated block;

a circuit for supplying RGB analog signals to a display means selected from a CRT of a television set and a RGB monitor, said RGB analog signals being obtained by a digital to analog conversion of RGB color data read from said color table RAM;

a matrix ROM for storing luminance signals and color difference signals at addresses each defined by said RGB color data, addresses of said matrix ROM being designated by said RGB color data read from said color table RAM; and a circuit for supplying a composite signal to a receiving circuit of a television set, said composite signal being obtained by an analog luminance signal to which a luminance signal read from said matrix ROM is converted, and color carriers generated from analog color difference signals, to which color difference signals read from said matrix ROM are converted, in accordance with a modulation by use of color subcarriers.

2. An apparatus for producing video signals according to claim 1 further comprising, means for transferring said RGB color data to said color table RAM for storing said data, means for producing a delay signal for a predetermined time after a transfer of said RGB color data is finished by said means for transferring, and means for inhibiting a display of said RGB color data read from said color table RAM during a transfer period of said RGB color data and during an output period of said delay signal.

3. An apparatus for producing video signals according to claim 2.

wherein said means for inhibiting includes a latch circuit for latching said RGB color data in accordance with a dot clock, and a gate circuit for inhibiting supply of an output from said dot clock to said latch circuit during said output period.

* * * * *